US007434899B2

(12) United States Patent
Nakajima

(10) Patent No.: US 7,434,899 B2
(45) Date of Patent: Oct. 14, 2008

(54) INKJET RECORDING METHOD AND INKJET RECORDING INK FOR THAT METHOD

(75) Inventor: Atsushi Nakajima, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 421 days.

(21) Appl. No.: 11/186,685

(22) Filed: Jul. 21, 2005

(65) Prior Publication Data

US 2006/0028497 A1 Feb. 9, 2006

(30) Foreign Application Priority Data

Aug. 4, 2004 (JP) ..... 2004-227863

(51) Int. Cl.
*B41J 29/38* (2006.01)

(52) U.S. Cl. ..... 347/6; 347/10

(58) Field of Classification Search ..... 347/6
See application file for complete search history.

(56) References Cited

U.S. PATENT DOCUMENTS 5,169,438 A * 12/1992 Matrick ..... 106/31.86
6,299,675 B1 * 10/2001 Ono et al. ..... 106/31.27
6,527,354 B2 * 3/2003 Takahashi ..... 347/9
7,128,381 B2 * 10/2006 Cheng et al. ..... 347/10
7,270,408 B2 * 9/2007 Odell et al. ..... 347/102
2005/0018009 A1 * 1/2005 Otsubo ..... 347/36
2005/0219290 A1 * 10/2005 Iwao et al. ..... 347/10
2006/0012624 A1 * 1/2006 Vanhooydonck ..... 347/15

* cited by examiner

*Primary Examiner*—Matthew Luu
*Assistant Examiner*—Brian J. Goldberg
(74) *Attorney, Agent, or Firm*—Lucas & Mercanti, LLP

(57) ABSTRACT

An inkjet recording method including the steps of: ejecting an ink having viscosity from 5 to 20 mPa·s from a nozzle of an inkjet head toward a recording medium; forming a main droplet and at least one satellite out of the ink; controlling a drive voltage of the inkjet head to make conditions that a velocity of the main droplet is at least 5 m/s at a point 1 mm away from a surface of the nozzle, and that a distance between the main droplet at the point 1 mm away from the nozzle surface and a satellite at the end of the at least one satellite is at most 500 μm; and recording an image of the ink on the recording medium.

11 Claims, 4 Drawing Sheets

FIG. 2 ( a )
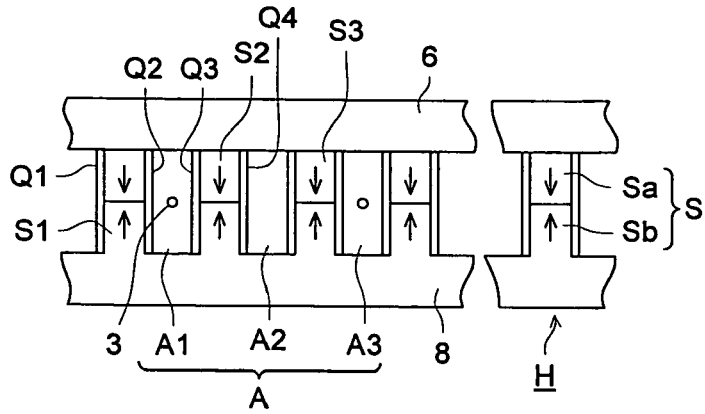
FIG. 2 ( b )
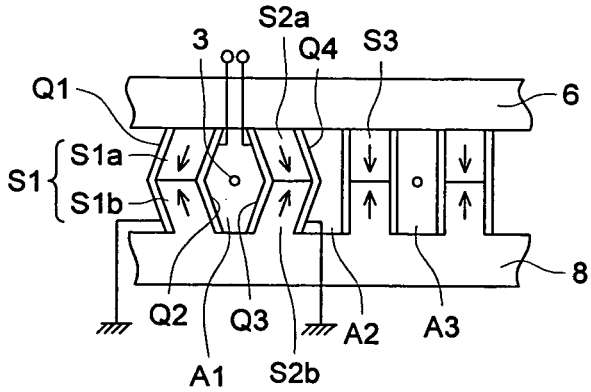
FIG. 2 ( c )
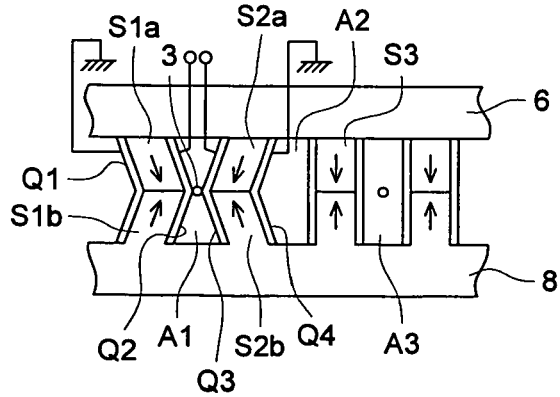

WAVEFORM OF THE DROPLET AT THE END IS DIFFERENT FROM THE OTHERS

ALL THE WAVEFORMS ARE SAME

INKJET RECORDING METHOD AND INKJET RECORDING INK FOR THAT METHOD

This application is based on Japanese Patent Application No. 2004-227863 filed on Aug. 4, 2004 in Japanese Patent Office, the entire content of which is hereby incorporated by reference.

BACKGROUND OF THE INVENTION

1. Field of the Invention

The present invention relates to an inkjet recording method of using comparative high viscous inks which are hardened, for example, by ultraviolet rays. Particularly, this invention relates to an inkjet recording method which has excellent ink-ejection stability and outputs high-definition images with suppressing generation of ink mists, and to inkjet recording inks for the method.

2. Background of the Art

Various researches and developments have been made on inkjet recording methods to improve and give higher functions to inkjet recording inks (hereinafter simply called "inks") and inkjet nozzles.

Recently, various kinds of inkjet recording methods have been available as solvent inkjet printers which use particular solvents, UV-setting inkjet printers which do not choose recording media, and so on. They have been vigorously applied to printing in graphic fields, printing of flat-panel displays (organic EL polymer, organic EL light emitter, liquid crystal spacer, liquid crystal color filter, etc.), and printing of substrates.

Various kinds of ink have been used such as inks which use pigment, dispersed dye, metal particles, and so on as color materials; inks whose physical property greatly changes by gelation or exposure to ultraviolet rays after being ejected; and inks which use high-security solvents. These highly functional inks are apt to lose their ejection abilities quickly. This is mainly because the additives to give functionalities to the ink increase the viscosities of the ink and thixotropic properties in the dispersion system, and reduces the surface tension of the ink liquid.

Meanwhile, the recording head of the inkjet printing apparatus has been requested to accomplish downsizing of ink droplets, increase of gradations, increase of production volumes, increase of the number of nozzles, higher ink ejection accuracy, and durability and reliability of functional ink.

The use of high-viscous dispersed inks and small droplets and high frequency head in combination may be a problem in assuring the stability of ink ejection. Particularly, major problems in high-frequency ejection of high viscosity inks through nozzles of a small diameter are generation of many satellites from ink droplets and resulting ink mists which waft in the air before the recording medium.

To make each droplet land exactly, the speed of a main droplet must be increased to some extent. A higher liquid speed makes the liquid column from a nozzle longer and is apt to generate ink satellites. If the ink has a low surface tension, the liquid column is broken into a lot of small liquid pieces (satellites) of lower speeds. This becomes an ink mist.

This ink mist not only contaminates the recording medium but also deteriorates the ink ejection ability when deposited on the inkjet nozzle. Further, to remove ink deposit and stabilize ink ejection, an additional process is required to clean the inkjet nozzle. This will reduce the print productivity of the inkjet recording apparatus and make the apparatus complicated (by provision of a recovery mechanism). If the relative speed between the carriage and the recording medium is increased to improve the print productivity, the satellites may be affected by winds and lose their speed. This will increase the ink mist. This phenomenon becomes more striking when main droplets are made smaller.

If the ink contains a persistent material such as pigment, persistent polymer, inorganic material, or metal, a mist of micro-particles (e.g. some μm or particularly 1 μm or less in size) of such persistent inks is harmful to human bodies because, when inhaled deep in the alveoli of the lung, the micro-particles will remain there.

Some methods have been proposed to suppress generation of ink mists. They are a method of suppressing disturbance of the air caused by the reciprocal movement of the carriage (see Patent Document 1), a method of attracting the ink mist by an electrostatic member (see Patent Document 2), a method of attaching the satellites by a certain driving condition of the piezoelectric element to the main droplets (see Patent Document 3), and a method of coalescing satellites into larger droplets before they reach the recording medium (see Patent Document 4).

However, the above methods are not enough to substantially suppress contamination of recording media with ink, ink deposition on inkjet nozzles, and deterioration in ink ejection stability. The generation of ink mists is dependent upon ink prescriptions, head driving conditions, and recording conditions in addition to the conditions of small droplets (20 pl or less), multi-gradation recording by multi-drops, high-speed movement of inkjet nozzles to get high print productivity (carriage speed), use of functional pigments, and high-viscosity ink which mainly contain polymeric monomers. Therefore, it has been very difficult to dissolve such problems.

Particularly, it has been very difficult for process color inks to have good dispersibilities. Especially, yellow and magenta pigments are apt to generate ink mists.

[Patent Document 1]
Japanese Non-Examined Patent Publication 2004-42580

[Patent Document 2]
Japanese Non-Examined Patent Publication 2003-237110

[Patent Document 3]
Japanese Examined Patent Publication H05-57913

[Patent Document 4]
Japanese Non-Examined Patent Publication 2002-144570

SUMMARY OF THE INVENTION

An object of the present invention is to provide an ink recording method and inkjet recording inks which enable stable recording which uses small droplets of high viscosity ink without generating any ink mist particularly in a multi-drop driving process and thereby to form high-definition images.

The above object can be accomplished by the structures below.

(1) An inkjet recording method of jetting out droplets of ink of 5 to 20 mPa.s (milli-pascal second) in viscosity from inkjet nozzles to recording media, wherein recording is carried out under conditions that each jetted-out droplet comprises a main droplet body and satellites, that the velocity of the main droplet body is 5 m/s or more at a point 1 mm away from the nozzle surface, and that the distance between the main droplet body and the satellite at the end is 500 μm or less at a point 1 mm away from the nozzle surface.

(2) The inkjet recording method of (1), wherein the ink droplet has up to 10 satellites.

(3) The inkjet recording method of (1) or (2), wherein said ink is high-viscosity ink whose a high-viscosity is 10 mPa.s or more at 25° C. and the viscosity of the ink is heated to be 5 to 20 mPa.s for recording.

(4) The inkjet recording method of any of (1) to (3), wherein said ink contains a pigment as a color material and said ink contains up to five large pigment particles having diameters of at least 1 μm, per 1000 $\mu m^2$ under a microscope when a 3 μm layer of the ink is formed on a transparent base material.

(5) The inkjet recording method of (4), wherein said ink contains a polymer dispersant to disperse said pigment and the content of the polymer dispersant free from the pigment is 1% or less.

(6) The inkjet recording method of any of (1) to (5), wherein the viscosity of the ink to be jetted out is controlled to 5 to 12 mPa.s for recording.

(7) The inkjet recording method of any of (1) to (6), wherein said ink is hardened by ultraviolet rays.

(8) The inkjet recording method of any of (1) to (7), wherein said inkjet recording method is of the multi-drop driving type which uses a plurality of main droplets.

(9) The inkjet recording method of (8), wherein the drive waveform of the droplet at the end which is jetted out last in the set of droplets in the multi-drop process is different from the drive waveforms of the other droplets which are all droplets excluding the droplet at the end.

(10) The inkjet recording method of any of (1) to (9), wherein inks for the inkjet recording method is limited.

(11) Inkjet recording inks which are used for the inkjet recording method of any of (1) to (10).

BRIEF DESCRIPTION OF THE DRAWINGS

FIG. 2(*a*) to 2(*c*) respectively show a sectional view of a shear mode type inkjet head along the ink channel.

FIG. 4(*b*) shows an example in which the waveform of the last jetted droplet is different from the waveforms of the other droplets in the set.

DETAILED DESCRIPTION OF THE PREFERRED EMBODIMENT

Figure 1:
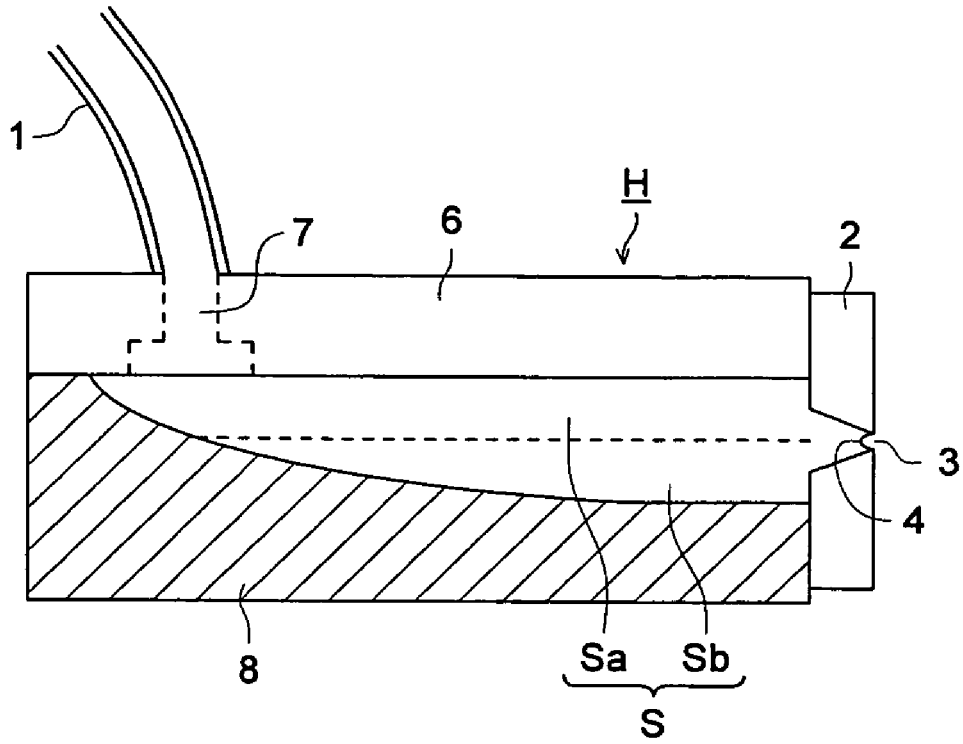
FIG. 1 shows a sectional view of a shear mode type inkjet head along the ink channel.

Below will be explained the present invention in detail.

The inkjet recording inks for the inkjet recording method of the present invention can be any of water-based inks which contains water as the principal ingredient, oil- or solvent-based ink which contains an organic solvent as the principal ingredient, solid inks such as wax inks which are heated and molten for use, and UV-hardening inks which hardens when exposed to ultraviolet rays.

The present invention is preferably available to UV-hardening inks and hot-melt inks which are solid or viscous liquid at ambient temperatures but has a viscosity of 5 to 20 mPa.s when heated.

The ink in the above viscosity range (5 to 20 mPa.s) of the present invention means that it is more viscous in the ink ejection process than the generally used inkjet recording inks.

The main droplet velocity of 5 m/s or more at a point 1 mm away from the nozzle surface means that the ink droplets are jetted out at a very high velocity.

As explained above, when a droplet of high-viscosity ink is jetted out, the ink droplet is usually divided into a main droplet body and lots of satellites (smaller and slower droplets which follow the main droplet body). In this invention, each droplet should preferably have up to ten satellites. It is also preferable that the droplet has no satellite.

The present invention is based on that, when an ink droplet comprises one main droplet body and lot of satellites, the distance between the main droplet body and the satellite at the end must be 500 μm or less and that a mist problem will occur if this distance is 500 μm or more. The main feature of this invention is not the number of satellites but the distance between the main droplet body and the satellite at the end and that the mist problem in actual recording service will be suppressed more completely as the distance becomes shorter. If the distance exceeds 500 μm, the satellite reduces its size and velocity. As the result, the satellites lose their velocities by a disturbance of the air and are apt to form a mist. The more preferable distance between the main droplet body and the satellite at the end is 300 μm or less.

The multi-drop driving process using a plurality of main droplets indicates inkjet nozzles that can apply a plurality of ink droplets to one picture element for multi-gradation (gray scales). This kind of a gray-scale head is useful for printers which aim photo-like images, UV-hardening inkjet recording method which applies a heavy load (e.g. a heavy light source) to the carriage, and a line recording method which requires a lot of nozzles. However, the multi-drop process may frequently generate mists because of a lot of liquid droplets and a lot of liquid column breaking points. In the multi-drop process, the ink mist can be suppressed by controlling the distance between the main droplet at the end and the satellite at the end. The preferable distance is 300 μm or less.

The number of satellites per main droplet should be 10 or less and more preferably 5 or less. The number (count) of satellites means the number of satellites observed at a point at which the main droplet is 1 mm away from the nozzle surface. In the multi-drop process, the number of satellites between two successive main droplets is counted as the trailing satellites are coalesced with the succeeding main droplet.

High-viscosity inks whose viscosity is 10 mPa.s or more (usually 20 mPa.s or more) at 25° C. is heated to keep the viscosity at 5 to 20 mPa.s for ink ejection. The viscosity is preferably 5 to 12 mPa.s, and more preferably 5 to 10 mPa.s. The reduction in ink viscosity by heating is very effective to suppress generation of satellites.

The viscosity (mPa.s) in the present invention can be any provided it is assayed by a reference solution for calibration of viscometers which is specified by JIS Z 8809. The viscosity value is what is measured at a preset temperature and a shear rate of 1000 $s^{-1}$ by a well-known method. Any type of viscosity measuring apparatus can be used. The apparatus can be a rotational viscometer, oscillation type viscometer, or capillary type viscometer, for example, Saybolt viscometer, Redwood viscometer, MCR300 (by Physica), cone-and-plate viscometer E-type viscometer (by TOKIMEC Inc.), E type viscometer (rotational viscometer by Toki Sangyo Co., Ltd.), B type viscometer BL (by Tokyo Keiki Co., Ltd.), FVM-80A (by Yamaichi Electronics Co., Ltd.), Viscoliner (by Nametore), and VISCOMATE MODEL VM-1A and DD-1 (by Yamaichi Electrics Co., Ltd.)

(Pigment)

The inkjet recording inks of the present invention can use various color materials such as dyes and pigments. The preferable color materials are pigments. Specifically, pigments below are available.

C.I. Pigment yellow 1, 2, 3, 12, 13, 14, 16, 17, 73, 74, 75, 81, 83, 87, 93, 95, 97, 98, 109, 114, 120, 128, 129, 138, 139, 151, 154, and 180

C.I. Pigment red 5, 7, 12, 22, 38, 48:1, 48:2, 48:4, 49:1, 53:1, 57:1, 63:1, 101, 112, 122, 123, 144, 146, 168, 184, 185, and 202

C.I. Pigment violet 19, and 23

C.I. Pigment blue 1, 2, 3, 15:1, 15:2, 15:3, 15:4, 18, 22, 27, 29, and 60

C.I. Pigment green 7 and 36

C.I. Pigment white 6, 18, and 21

C.I. Pigment black 7

Preferable process color sets for inkjet recording inks of the present invention are combinations of four types of pigments below.

Y: C.I. Pigment yellow 120, 128, 74, 83, 138, 151, and 180

M: C.I. Pigment violet 19 and Pigment Red 122

C: C.I. Pigment blue 15:4

K: C.I. Pigment black 7

W: C.I. Pigment white 6

It is preferable that the surfaces of pigments are treated by a basic, acidic, or polar process. A preferable material for surface treatment of pigments is a synergist which has a structure similar to that of the pigment and whose surface is treated by a basic, acidic, or polar process. A "synergist" is an organic material which has a pigment-like structure whose coloring material or organic pigment cores are modified with polar groups such as acidic or basic groups and coupled with the polar groups directly or by joints. When absorbed by the surface of the pigment and coupled with a dispersant, the synergist can increase the dispersibility of the pigment. However, almost all synergists are not light-stable. Therefore when the pigment is treated too much by the synergist, the original light-fastness of the pigment will be deteriorated. Available polar groups are, for example, sulfonic, carboxylic, phosphoric, boric, and hydroxyl groups. Among them, sulfonic and carboxylic groups are preferable and sulfonic groups are more preferable.

Some methods for preparing pigment particles having polar groups on their surfaces have been disclosed by, for example, International Patent Pamphlet 97/48769, Japanese Non-Examined Patent Publications H10-110129, H11-246807, H11-57458, H11-189739, H11-323232, and 2000-265094. These methods respectively apply polar groups such as sulfonic groups or their salts to at least part of surfaces of pigment particles by treating the surfaces with adequate oxidizing agents. Specifically, particle surfaces can be treated by oxidizing carbon blacks with concentrated nitric acid or oxidizing surfaces of color pigments with sulfamic acid, sulfonated pyridine salts, sulfuric amidic, and so on in Sulfolane or N-methyl-2-pyrrolidone. If the particle surfaces are oxidized too far in the above reactions, the particles become water-soluble and can be easily removed. With this, a pigment dispersing liquid can be obtained. When pigment surfaces are oxidized with sulfonic acid, the acidic groups on the pigment surfaces can be neutralized with a basic compound.

There still have been other methods: a method of attaching pigment derivatives to surface of pigment particles by milling, which has been disclosed by Japanese Non-Examined Patent Publications H11-49974, 2000-273383, and 2000-303014 and a method of dissolving pigments and their derivatives in a solvent and crystallizing them in a poor solvent, which has been disclosed by Japanese Non-Examined Patent Publications 2002-179977 and 2002-20141. These methods can easily prepare pigment particles whose surfaces have polar groups.

In the present invention, polar groups can be free, salts, or counter-salts. The counter-salts are selected, for example, from a group of inorganic salts (lithium, sodium, potassium, magnesium, calcium, aluminum, nickel, and ammonium salts), organic salts (tri-ethyl-ammonium, di-ethyl-ammonium, pyridinium, and tri-ethanol-ammonium salts, etc.). They should preferably be monovalent counter salts.

A preferable synergist should be denatured by sulfonic acid or carboxyl group and its amine value should be greater than the acid value.

It is preferable to add 1 to 50 mass parts of synergist to 100 mass parts of pigment.

To disperse pigments, are used ball mill, sand mill, attrition mill, roll mill, agitator, Henschel mixer, colloidal mill, ultrasonic homogenizer, pearl mill, wet jet mill, paint shaker, and so on.

For pigment dispersion, pigments, dispersants, dispersing media, dispersing conditions, and filtering conditions are selected to disperse pigments of 80 to 150 nm in average particle diameter. The average particle diameter of pigments in the pigment dispersing liquid can be measured by a transmission electron microscope or an optical method such as a laser scattering method.

Usually, large particles in the inkjet ink are removed by a membrane filter or the like. However, substantially, the filtered pigments may be re-flocculated at a certain probability by filtration and shearing or as the time goes by. These large particles are very few and cannot be observed by any light-scattering particle size analyzer.

When applied 3 μm thick on a transparent base material and observed by a microscope, the inkjet recording ink of the present invention should preferably contain up to 5 large particles (of 1 μm or greater) per 1000 $\mu m^2$ of the viewing field of the microscope. When the count of the large particles is 5 or less, it is possible to reduce both the distance between the main droplet body and its satellites and the number of satellites. It is more preferable that the count of the large particles is 1 or less.

The reason for this has not been known, but it can be assumed that larger particles are apt to break liquid columns and that, immediately when a liquid column is extruded from an ink meniscus, the liquid column starts to break at the large particles in the liquid column and produces slower fine satellites.

(Polymer Dispersing Agents)

When the inkjet recording ink of the present invention uses a low-polarity polymeric compound as a dispersing medium or a pigment as a color material, a polymer dispersing agent is preferably used to secure the dispersion stability of the pigment.

The polymer dispersing agents should preferably contain base or acid to absorb a pigment. Either base or acid can be used similarly and provide the same good effect. Available polymer dispersing agents are carboxylate ester containing hydroxyl group, ester of long-chain poly-amino-amide and high-molecular-weight acid, salt of high-molecular-weight polycarboxylic acid, salt of long-chain poly-amino-amide and polar acid ester, high-molecular-weight unsaturated acid ester, high-molecular copolymer, denatured polyurethane, denatured polyacrylate, polyether ester type anionic activator, salt of naphthalene sulfonic formalin condensate, salt of sulfonic formalin condensate, salt of aromatic sulfonic formalin condensate, polyoxy ethylene alkyl phosphoric ester, polyoxy ethylene nonyl phenyl ether, stearyl amine acetate, pigment derivatives, and so on.

Their concrete products are listed below:

BYK Chemie products of Anti-Terra-U (poly-amino-amide phosphate), Anti-Terra-203/204 (high-molecular-weight poly-carboxylate), Disperbyk-101 (ester of poly-amino-amide phosphate and acid), Disperbyk-107 (carboxylic ester containing hydroxyl group) Disperbyk-110 (copolymer containing acid groups), Disperbyk-130 (poly-amide), Disperbyk-161, -162, -163, -164, -165, -166, and -170 (polymer copolymers), Disperbyk-400, Bykumen (high-molecular-weight unsaturated acid ester), BYK-P104 and -P105 (high-molecular-weight unsaturated polycarboxylic acid), P104S and 240S (high-molecular-weight unsaturated polycarboxylic acid and silicone), and Lactimon (long-chain amine, unsaturated polycarboxylic acid, and silicone).

Efka Chemicals products of Efk 44, 46, 47, 48, 49, 54, 63, 64, 65, 66, 71, 701, 764, and 766, Efk polymer 100 (denatured polyacrylate), Efk 150 (aliphatic denatured polymer), Efk 400, 401, 402, 403, 450, 451, 452, 453 (denatured polyacrylate), Efk 745 (copper phthalocyanine series).

KYOEISYA CHEMICAL Co., Ltd. products of Floren TG-710 (urethane oligomer), Flonon SH-290, SP-1000, and Polyflow No. 50E and No. 300 (acrylic copolymer).

Kusumoto Chemicals products of Disperon KS-860, 873SN, and 874 (polymer dispersing agent), #2150 (aliphatic multi-valent carboxylic), and #7004 (polyether ester).

Kao products of Demol RN, N (sodium salt naphthalene sulfonic formalin condensate), MS, C, SN-B (sodium salt aromatic sulfonic formalin condensate), and EP, Homegenol L-18 (polycarboxylic polymer), Emulgen series surfactant 920, 930, 931, 935, 950, and 985 (polyoxy-ethylene nonyl phenyl ether), and Acetamine 24 (coconut amine acetate) and 86 (stearyl amine acetate).

Zeneca Limited products of Solspaz 5000 (phthalocyanine ammonium salt), 13240, 13940 (polyester amine seris), 17000 (fatty acid amine series), 24000, and 32000.

Nikko Chemicals products of Nikkol T106 (polyoxy ethylene sorbitan-mono-orate), MYS-IEX (poly-oxy-ethylene-mono-stearate), and Hexagline 4-0 (hexa-glyceryl-tetra-orate).

When the ink contains free polymer dispersing agent (which is not linked with pigments) or when the ink contains surplus polymer dispersing agent, the dynamic viscosity of the ink does not go down even when the ink is jetted out from a nozzle in the high shear rate. This increases the distance between the main droplet and satellites and deteriorates the ink ejection stability. As the result of inventors' study, it was found that the distance between the main droplet and satellites increases under coexistence of solid particles and polymer. In the ink, which contains no solid particle, the distance between the main droplet and satellites is not likely to increase. Average particle diameter of the solid particles is preferably 80-150 nm, as described in the session of Polymer dispersing agents. When the average particle diameter is greater than 150 nm, the effect of increasing the distance between the main droplet and satellites is enhanced. High dynamic viscosity of ink may induce generation of satellites, frequent generation of mists, increase of blocked nozzles, reduction in ejection accuracy, and so on. Further, the surplus dispersing agent will make ink hardening uneven and cause hardening wrinkles.

The quantity of free polymer dispersing agent can be determined by separating pigments from the ink by a ultra centrifugation, filtration, or chromatography, sampling a transparent liquid, and analyzing thereof. Further, as the polymer dispersing agent is preferably attached to the surfaces of pigment particles by an acid or base reaction, the quantity of free polymer dispersing agent can be determined by measuring the acid value or amine value of the above extracted ink. The acid value and the amine value can be obtained by a potentiometric titration. For example, the quantity of free polymer dispersing agent can be determined by a method specified by Report of Japan Society of Colour Material Vol. 61 [12], pp 692-698(1988). When the ink uses pigments and dispersing agents, their mass average is used. A viscosity measuring method and a spectroscopic analysis method are also available as to measure the quantity of free polymer dispersing agent. In addition to them, a liquid chromatography and a gel permeation chromatography (GPC) are available as separating quantitative analyses.

The surplus polymer dispersing agent should be 1.0% or less by mass of the whole weight of the ink and preferably 0.5% or less by mass to greatly suppress the generation of mists.

(Polymeric Compounds)

Among polymeric compounds available to the present invention, radical polymeric compounds can be compounds listed, for example, in Japanese Non-Examined Patent Publications H07-159983, H08-224982, and H10-863 and Japanese Examined Patent Publication H07-31399. Well-known cationic polymeric monomers can be used as cationic polymeric compounds of this invention. Such compounds can be epoxy compounds, vinyl ether compounds, and oxetane compounds which are listed, for example, in Japanese Non-Examined Patent Publications H06-9714, 2001-31892, 2001-40068, 2001-55507, 2001-310938, 2001-310937 and 2001-220526.

Radical polymeric compounds are compounds that have ethylenic bonds capable of radical polymerization. The radical polymeric compounds can be any provided the compound has at least one ethylenic bond capable of radical polymerization in its molecule. They can be of any chemical form (monomer, oligomer, and polymer). The radical polymeric compounds can be used singly or in combination (at any ratio) to improve a target characteristic. Radical polymeric compounds having ethylenic unsaturated bonds can be, for example, unsaturated carboxylic acids (e.g. acrylic acid, methacrylic acid,. itaconic acid, crotonic acid, iso-crotonic acid, and maleic acid) and their salts, esters, urethanes, amides and anhydrides, acrylonitriles, styrenes, various unsaturated polyesters, unsaturated polyethers, unsaturated polyamides, and unsaturated urethanes.

The content of a radical polymeric compound should preferably be 1 to 97% by mass of the whole ink and more preferably 30 to 95% by mass.

The cationic polymeric ink should preferably contain at least one oxetane compound and at least one compound selected from a set of epoxy compound and vinyl-ether compound. Judging from the fast curing ability, epoxy compounds should be aromatic epoxy compounds and alicyclic epoxy compounds. Particularly, the alicyclic epoxy compounds are preferable. In the present invention, the above epoxy compounds can be used singly or in combination. Judging from the hardening ability, adhesiveness, and surface hardness, vinyl ether compounds should be di- or tri-vinyl ether compounds. Particularly, the di-vinyl ether compounds are preferable. In this invention, the above vinyl ether compounds can be used singly or in combination.

The oxetane compound is a compound which contains oxetane rings. This invention can use all known oxetane compounds such as those introduced in Japanese Non-Examined Patent Publications 2001-220526 and 2001-310937. When the oxetane compound (molecule) contains five or more oxetane rings, the viscosity of the ink composition increases, which makes the ink composition harder to be handled. Further, this compound also increases the glass transition temperature of the ink composition and decreases the adhesiveness of the hardened material. Therefore, the oxetane compound (molecule) of this invention should preferably have 1 to 4 oxetane rings.

(Photo-Induced Polymerization Initiators)

The present invention uses a photo-induced polymerization initiator to advance the hardening reaction efficiently. The photo-induced polymerization initiator is classified into two: radical polymeric compound which generates radicals and cationic polymeric compound which generates photoacids. The radical generator is loosely classified into two: bond-splitting type which splits bonds in molecules and hydrogen-abstracting type which abstracts hydrogen from molecules.

The bond-splitting type radical generators are, for example, acetophenone series {e.g. diethoxyacetophenone, 2-hydroxy-2-methyl-1-phenyl propane-1-on, benzyl-dimethyl-ketal, 1-(4-isopropylphenyl)-2-hydroxy-2-methylpropane-1-on, 4-(2-hydroxyethoxy)-phenyl-(2-hydroxy-2-propyl) ketone, 1-hydroxy-cyclohexyl-phenyl ketone, and 2-methyl-2-morpholino-(4-thiomethylphenyl)-propane-1-on)}, α-aminoketone series {e.g. 2-benzyl-2-dimethyl-amino-1-(4-morpholinophenyl)-butanone)}, benzoin series (e.g. benzoin, benzoinmethylether, and benzoinisopropylether), bis-acylphosphineoxide series {bis-(2, 4, 6-trimethyl-benzoyl) phenylphosphineoxide}, and benzylmethyl-phenylglyoxy ester.

Meanwhile, the hydrogen-abstracting type radical generators are, for example, benzophenone series {e.g. benzophenone, o-benzoylbenzoic met hyl-4-phenyl benzophenone, 4,4'-dichlorobenzophenone, hydroxybenzophenone, 4-benzoyl-4'-methyl-diphenyl sulfide, acrylic benzophenone, 3,3', 4,4'-tetra (t-butyl-peroxycarbonyl) benzophenone, and 3,3'-dimethyl-4-methoxybenzophenone}, thioxanthone series (e.g. 2-isoprppylthioxanthone, 2,4-dimethyl-thioxanthone, 2,4-diethyl-thioxanthone, and 2,4-dichlorothioxanthone), aminobenzophenone series (e.g. Michler's ketone, and 4,4'-diethyl-aminobenzophenone), 10-butyl-2-chloroacridone, 2-ethyl-anthraquinone, 9,10-phenanthrenequinone, and camphorquinone, and so on.

The compounding ratio of the radical generator should preferably be 0.01 to 10.00% by mass of the UV-hardening ink.

Among these photo-induced polymerization initiators, bis-acyl-phosphin-oxide which has a photo-bleaching ability and α-aminoketone which is hard to be inhibited by oxygen are preferable because they have an effect to increase the sensitivities of ink droplets. Bis-acyl-phosphin-oxide and α-aminoketone products are available as the Irgacure series (fabricated by Chiba Specialitis Chemicals Co., Ltd.).

When a radical polymeric compound is used to harden very small droplets (e.g. less than 20 picoliters), their hardening may be decelerated by oxygen. If a lot of such initiators are used to fully harden the ink droplets, the odor of decomposed initiators will stimulate users' nostrils. Therefore, photo-induced polymerization initiators containing hydroxyethoxyl groups are preferable because they generate little odor when they are decomposed. Irgacure 2959 (fabricated by Chiba Specialitis Chemicals Co., Ltd.) represents such photo-induced polymerization initiators.

Available photoacid generators are, for example, chemically-amplified photoresists and compounds for photocationic polymerization ("Imaging Organic Materials" edited by The Japanese Research Association for Organic Electronics Materials, published by Bun-Shin (1993), pp 187-192).

Below will be listed preferred compound examples for this invention.

First such compounds are $B(C_6F_5)_4^-$, $PF_6^-$, $AsF_6^-$, $SbF_6^-$, and $CF_3SO_3^-$ salts of aromatic onium compounds such as diazonium, ammonium, iodonium, sulfonium, and phosphonium.

The photo-induced polymerization initiators which are preferably used in the present invention can be those listed in Japanese Non-Examined Patent Publications 2003-213184, 2003-306622, 2003-342499, 2003-252979, and 2003-253155.

(Polymerization Inhibitors)

In the present invention, a polymerization inhibitor can be added to the ink to suppress polymerization by heat and active light rays. Various compounds have been known as polymerization inhibitors and this invention can directly use compounds that have been widely used in general polymeric compositions.

As polymerization inhibitors used are phenollic antioxidants, amine compounds, phosphorus antioxidant, hydroquinone-mono-methyl-ether which is widely used for (meth)-acrylic monomer, hydroquinone, t-butyl catechol, pyrogallol, and water. These are described in detail in "Technology for developing polymer additives" (published by CMC). Judging from the reaction mechanism, a phenollic compound having double bonds derived from acrylic acid in its molecule can catch R— groups. Therefore, even when heated in a closed oxygen-free system, the compound can have an effect to suppress polymerization and can be preferably used in this invention. Specifically, such compounds are available as Sumilizer GA-80, Sumilizer GM, and Sumilizer GS (fabricated by Sumitomo Chemical Co., Ltd.)

It is preferable to add these polymerization inhibitors to a pigment dispersing liquid when the liquid is prepared. However, a surplus polymerization inhibitor in the ink will reduce the sensitivity of the ink. Therefore, it is preferable to determine such a quantity of polymerization inhibitor that does not deteriorate the storage stability of the ink and prevent polymerization in dispersion of pigments before adding it to the ink. It is also preferable to extract surplus polymerization inhibitor from the prepared pigment-dispersing liquid down to the required quantity of polymerization inhibitor.

When a cationic polymeric compound is used as the photo-induced polymerization initiator, the polymerization inhibitor should preferably be an amine compound. When the amine compound is combined with a dispersing agent whose acid value is higher than the amine value, the ink can have a well-balanced synergistic effect in storage stability and sensitivity. Among amine compounds as the polymerization inhibitors, the quaternary ammonium salt is particularly preferable for the cationic polymeric ink because it can suppress the dark reaction in storage without suppressing the reaction when the ink is exposed to UV light. If the dispersibility is not stable, tertiary amine having a low polarity is particularly preferable as a polymerization inhibitor. The quantity of amine compound to be added should be 0.01 to 1% by mass of the whole ink. If the quantity of the amine compound is less than 0.01% by mass, the storage stability of ink is not enough. Contrarily, if the quantity of the amine compound is greater than 1% by mass, the hardening sensitivity of the ink reduces.

(Other Additives)

The ink of the present invention is hardened by ultraviolet rays. A photosensitizer can be used to advance the hardening reaction efficiently. Such photosensitizers can be, for example, amines (e.g.-tri-ethanol amine, methyl-di-ethanol amine, tri-iso-propanol amine, 4-di-methyl-amino-benzoic methyl, 4-di-methyl-amino-benzoic ethyl, 4-di-methyl-amino-benzoic iso-amyl, benzoic-(2-di-methyl-amino) ethyl, 4-di-methyl-amino-benzoic-(n-butoxy) ethyl, and 4-di-methyl-amino-benzoic 2-ethyl-hexyl), cyanine, phthalocyanine, melocyanine, porphyrin, spiro compound, ferrocene, fluorene, fulgide, imidazole, perylene, phenazine, phenothiazine, polyene, azo compound, diphenyl-methane, tri-phenyl-methane, polymethine acridine, coumarin, keto-coumarin, quinacridone, indigo, styryl, pyrylium compound, pyrromethene compound, pyrazolotriazole compound, benzo-thiazole compound, barbituric derivatives, thiobarbituric derivatives, and compounds listed in EP Patent No.568,993, U.S. Pat. Nos.4,508,811 and 5,227,227, Japanese Non-Examined Patent Publications 2001-125255 and H11-271969.

The well-known cationic photosensitizers are available to this invention. Specifically, they are anthracene, pyrene, perylene, acridine orange, thioxanthone, 2-chlorothioxanthone, benzofurabin, eosin, rose bengal, erythrocin and methylene blue.

The quantity of photosensitizer to be added should be 0.01 to 10.00% by mass of the ink composition.

It is preferable that the ink of the present invention contains a surface active agent. Any of cationic, anionic, amphoteric, and nonionic surface active agents can be used. Particularly nonionic surface active agents are preferable.

The nonionic surface active agents can be polyoxy ethylene-alkyl ether, polyoxy-ethylene secondary-alcohol ether, polyoxy-ethylene-alkyl-phenyl ether (for example, Emulgen series surfactant 911), polyoxy-ethylene-sterol ether, polyoxy ethylene lanolin derivatives, polyoxy-ethylene-polyoxy-propylene-alkyl ether (for example. New Pole PE-62), polyoxy-ethylene-glycerine-fatty-acid ester, polyoxy-ethylene castor oil, hydrogenated castor oil, polyoxy-ethylene-sorbitan fatty acid ester, polyoxy-ethylene-sorbitol fatty acid ester, polyethylene-glycol fatty acid ester, fatty acid monoglyceride, polyglycerine fatty acid ester, sorbitan fatty acid ester, propylene-glycol fatty acid ester, sucrose fatty acid ester, fatty acid alkanolamide, polyoxy-ethylene fatty acid amide, polyoxy-ethylene-alkyl amine, alkyl-amine oxide, acetylene glycol, and acetylene alcohol. Particularly, the above nonionic surface active agents are fluorinated surface active agents.

It is particularly preferable that the nonionic surface active agent in the present invention is a fluorinated surface active agent which contains a perfluoro-alkyl group in the molecule. Such fluorinated surface active agents can be perfluoro-alkyl ethylene oxido adducts, perfluoro-alkyl amine oxido, and oligomer which contains perfluoro-alkyl. Specifically, these nonionic surface active agents are available as products below.

SURFLON-series products fabricated by SEIMI CHEMICAL Co., Ltd.

SURFLON S-141, S-145, S-381, S-383, S-393, SC-101, SC-105, KH-40, and SA-100

MEGAFACE-series products fabricated by DAINIPPON INK AND CHEMICALS, INCORPORATED MEGAFACE F-171, F-172, F-173, F-177, F-178A, F-178K, F-179, F-183, F-184, F-815, F-470, and F-471.

These surface active agents can be used singly or in combination. It is possible to control the surface tension of the ink by adding the surface active agent by 0.001 to 1.0% (by mass) of the whole weight of the ink. However, it is to be understood that this invention is not intended to be limited to these compounds. It is possible to add an antiseptic agent and/or an antimold agent to the ink to store the ink stably for a long time.

The UV-hardening ink in accordance with the present invention is very viscous and apt to generate ink mists as the ink is a pigment-dispersion type. The generation of ink mists must be suppressed as much as possible because UV-hardening ink is a stimulant and sensitizing substance for human bodies.

The base materials can be paper, resin-coated paper (for example, coated with a polyethylene, polypropylene, polystyrene, or vinyl chloride film), and metallic sheets such as aluminum (including aluminum alloy), zinc, iron, and copper. In addition to these, the so-called inkjet recording having a porous ink receiving layer on a base material is also available to this invention.

Below will be explained an inkjet recording apparatus available to the present invention.

The inkjet recording apparatus available to the present invention can be of any ink-ejection type: electromechanical transducer type (e.g., single-cavity type, double-cavity type, vendor type, piston type, shear-mode type, and sheared wall type), and electro-thermal transducer type (e.g., thermal inkjet type and bubble jet® type). However, a print head of the piezoelectric type is preferable. Particularly the shear mode type is preferable since it can discharge ink droplets stably for a long time.

Below will be explained the details of the shear-mode ink-ejection method which is preferably used by the present invention with reference to the accompanying drawings. However, it is to be understood that the invention is not intended to be limited to the specific configurations in the drawings.

FIG. 1 shows ink-ejection apparatus H comprising ink tube 1, nozzle plate 2, nozzle 3, ink meniscus 4 which is formed by ink, side wall S of electromechanical transducing means, cover plate 6, ink supply port 7, and substrate 8.

Although FIG. 1 shows a sectional view of an ink channel having one nozzle, actual shear-mode droplet-ejection apparatus H contains odd-numbered ink channels (A1, A3, . . . , A2*n*−1) and even-numbered air channels (A2, A4, . . . , A2*n*) which are alternately partitioned from each other by side walls S (S1, S2, . . . , Sn+1) between cover plate 6 and substrate 8 (see FIG. 2(*a*)).

One end of each ink channel is connected to nozzle 3 which is formed on nozzle plate 2 and the other end of the ink channel is connected to an ink container (not shown in the drawing) with ink tube 1 via supply port 7. Nozzle 3 forms ink meniscus 4. For example, electrodes Q1 and Q2 are respectively attached to each side of side wall S1 Electrodes Q3 and Q4 are respectively attached to each side of side wall S2. In this manner, each side wall has electrodes on its sides.

Figure 3:
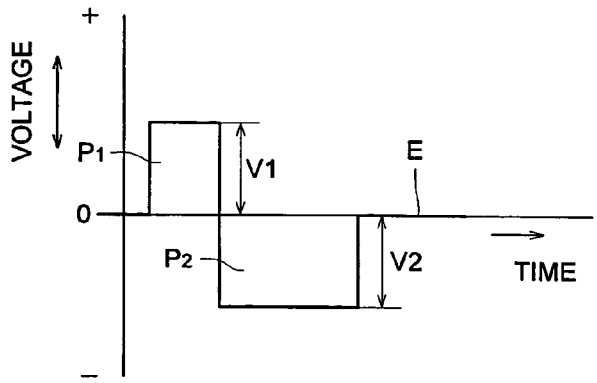
FIG. 3 shows drive pulse waveforms.

Let's assume that electrode Q1, for example, is connected to ground as shown in FIG. 2(*b*) and that drive pulse $P_o$ is applied to electrode Q2. As shown FIG. 3 , driving pulse $P_o$ comprises first pulse $P_1$ (positive peak value V1 and width J), second pulse $P_2$ (negative peak value V2 and width R), and preset time period E of voltage 0. Absolute values of voltages V1 and V2 of drive pulses $P_o$ in FIG. 3 are equal to each other. When electrode Q4 is connected to ground and drive pulses $P_o$ is applied to electrode Q3, ink droplets are ejected from nozzle 3 as explained below.

As shown in FIG. 2(*a*), each side wall (S1, S2, and so on) consists of two piezoelectric materials which have different polarization directions as indicated by arrows (S1*a*, S2*a*, . , and S1*b*, S2*b*, . .) so that side walls may deform and work as actuators when drive pulses are applied to the side walls. When no drive pulse is applied to electrodes Q2 and Q3, side walls S1 and S2 do not deform as shown in FIG. 2(*a*). When first pulse $P_1$ is applied to electrodes Q2 and Q3, an electric field generates perpendicularly to the polarization directions of the piezoelectric materials. Consequently, S1*a* and S1*b* of side wall S1 move to shear along their joint. Similarly, S2*a* and S2*b* of side wall S2 move in the opposite direction. In other words, the components (S1*a* and S1*b*) of side wall S1 and the components (S2*a* and S2*b*) of side wall S2 respectively deform outwards to increase the volume of ink channel A1 (in this example) as shown in FIG. 2(*b*). As shown in FIG. 2(*c*), when second pulse $P_2$ is applied to side walls S1 and S2, the components (S1*a* and S1*b*) of side wall S1 and the components (S2*a* and S2*b*) of side wall S2 respectively deform inwards to drastically reduce the volume of ink channel A1. This deformation increases the pressure in ink channel A1 and causes part of ink in ink channel A1 to change ink meniscus 4 in nozzle 3. As the result, an ink droplet jets out from nozzle 3. The other ink channels work similarly to jet out ink droplets.

Wherein, when voltage of the drive pulse is rather low, ejection velocity of the ink droplet becomes low (for example lower than 5 m/s), length of the ink column becomes shorter and number of generated satellites is suppressed to be small, however accuracy of droplet landing position becomes worse. On the other hand, when the voltage of the drive pulse is high, ejection velocity of the ink droplet becomes high (for example higher than 10 m/s) and accuracy of the landing position becomes high, however the length of the ink column becomes longer and number of the generated satellites increases and the satellites are tend to distribute to larger span. Therefore, it is preferable to control the drive pulse voltage so that the ejection velocity of the droplet becomes adequately high (at least 5 m/s) to ensure the accuracy of the landing position and to suppress the length of the ink column and the number of the generated satellites.

In the multi-drop method, it is possible to make satellites between the main droplet at the head and the main droplet at the end coalesce with main droplets to some extent by uniting the main droplet at the head and main droplets at the end in the air. However, satellites after the main droplet at the end cannot be coalesced with the main droplet.

It is preferable to suppress generation of satellites after the main droplet at the end by changing the drive waveform of the main droplet at the end so as to make the liquid column shorter.

Figure 4:
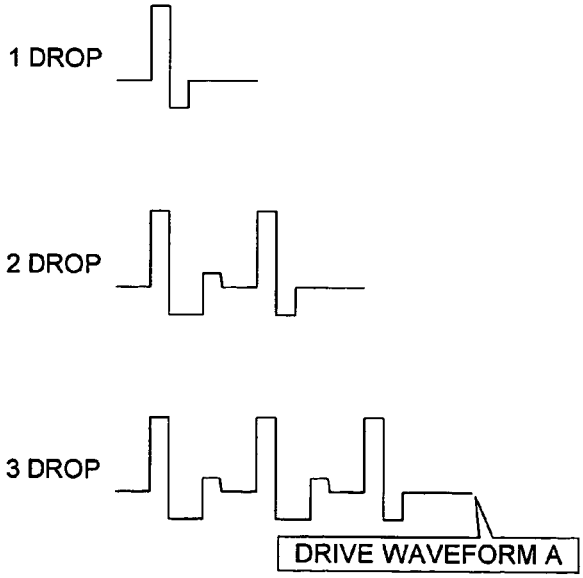
FIG. 4(*a*) shows an example in which all droplets in the multi-drop process have the same drive waveform.
Figure 4:
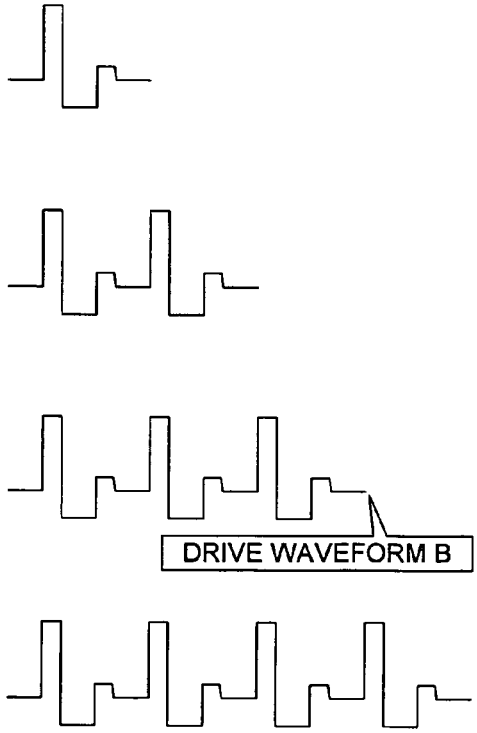

FIGS. 4(*a*), 4(*b*) show examples of drive waveforms to shot a single droplet and multiple droplets. FIG. 4(*b*) shows that all droplets (from the droplet at the head to the droplet at the end) are shot by identical waveforms. In the multi-drop ejection method, it is preferable to use a different drive waveform (as shown by FIG. 4(*a*)) to shoot the droplet at the end for suppressing generation of satellites.

In this invention, "ink limitation" means to limit the number of ink droplets to be ejected from inkjet nozzles or to make intermittent ejection breaks. This limitation can improve the condition of satellite generation and suppress generation of ink mists greatly. This limitation is particularly effective in the multi-drop method. Further, this limitation can dramatically reduce mist-related problems even when the carriage is driven fast.

Next will be explained an inkjet recording apparatus (or simply called recording apparatus below) which uses UV-hardening inks in accordance with this invention.

Figure 5:
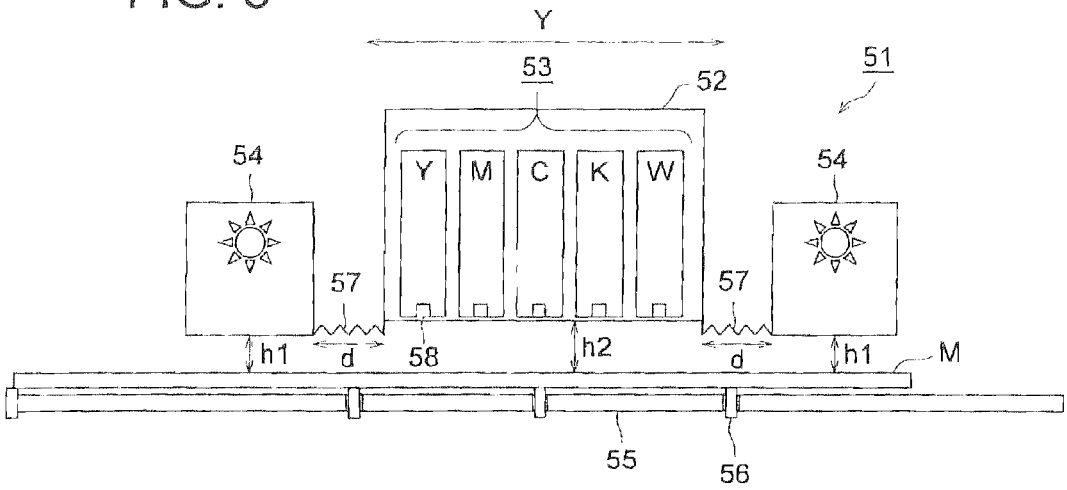
FIG. 5 shows the main configuration of a UV-hardening type inkjet recording apparatus.
Figure 6:
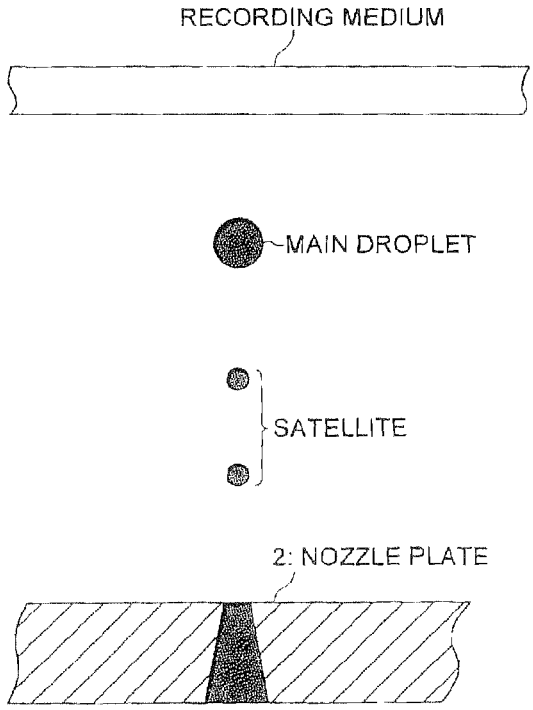
FIG. 6 shows a schematic view of a jetted main droplet and satellites.

FIG. 5 shows a recording mechanism of the inkjet recording apparatus which uses UV-hardening inks. Recording apparatus 51 comprises head carriage 52, recording head 53, UV emitting means 54, platen section 55, and others. Recording apparatus 51 provides platen section 55 under base material M. Platen section 55 has a function to absorb ultraviolet rays. Therefore, platen section 55 can absorb surplus ultraviolet rays which pass through base material M. As the result, high-definition images can be recorded stably.

Base material M is guided by guide member 56 and carried from front to back (perpendicularly to this page) by a delivery means (not shown in the drawing). A head scanning means (not shown in the drawing) reciprocally moves head carriage 52 along arrow direction Y to cause recording head 53 on head carriage 52 to scan.

Head carriage 52 is provided over base material M and houses a predetermined number of recording heads 53 (equal to the number of colors used for color-image printing) with their nozzles faced down. Head carriage 52 is provided on the main body of recording apparatus 51 so as to move reciprocally along arrow direction Y. A head scanning means drives head carriage 52 to move reciprocally along arrow direction Y.

In FIG. 5, head carriage 52 houses Y, M, C, K, and W recording heads 53 (Y for yellow, M for magenta, C for cyan, K for black, and W for white). Actually, however, the number of recording heads 53 housed in head carriage 52 is dependent upon the number of colors to be used for recoding. Further, W recording heads can be provided at both sides of the set of the Y, M, C, and K recording heads.

Each recording head 53 receives UV-hardening ink (abbreviated as UV ink) from the associated ink supply means (not shown in the drawing) and jets out the UV ink onto base material M through the associated nozzle by the associated ejection means (not shown in the drawing). The UV ink to be ejected by recording head 53 contains color materials, photopolymeric monomer, photo-induced polymerization initiator, and others as its ingredients. When exposed to ultraviolet rays, the monomer in the ink induces crosslinking and polymerization reactions by the photo-induced-polymerization initiator as the catalyst. This hardens the ink.

While driven by the head scanning means to move (or scan) from one end of base material M to the other end along arrow direction Y in FIG. 5, recording heads 53 eject droplets of UV inks onto a predetermined area (imaging area) of base material M. It is preferable to alternately jet out a droplet of color UV ink (Y, M, C, and K) and a droplet of white ink, apply UV light to each droplet, and repeat these steps to record an image.

This scanning is repeated a preset number of times to complete recording in a preset part of the imaging area. Then base material M is carried a preset distance from front to back (perpendicularly to FIG. 5) by the delivery means and the next scanning and ink ejections by recording head 53 are repeated on the imaging area part next to the above part of the imaging area.

While the above operation is repeated, recording head 3 jets out UV ink droplets in cooperation with the head scanning means and the delivery means to form an image which is an aggregation of UV ink droplets on base material M.

UV emitting means 54 comprises a UV lamp which emits ultraviolet light of a specified wavelength range at a constant light energy and a filter which passes light of a selected wavelength. Available UV lamps are, for example, mercury lamps, metal halide lamps, excimer laser, ultraviolet ray laser, hot cathode ray tubes, cold cathode ray tubes, black lights, and LEDs (light emitting diodes). Particularly, strip-shaped metal halide lamps, cold cathode ray tubes, mercury lamps or black lights are preferable.

UV emitting means 54 should be as wide as a maximum imaging area of recording apparatus (UV inkjet printer) 51 or wider than the imaging area that recording head 53 jets out ink droplets during a single scanning.

UV emitting means 54 are provided on both ends of head carriage 52 approximately in parallel with base material M.

A means to control the light intensity for the ink ejection section should necessarily shield the entire recording head 53 against UV light, but effectively controls the light intensity by reducing both distance h1 between UV emitting means 54 and base material M and distance h2 between recording head 53 and ink ejection section 58 (down to 2 mm or less or preferably 1.5 mm or less) and increasing distance d between recording head 53 and UV emitting means 54. It is more preferable to provide bellows structure 57 between recording head 53 and UV emitting means 54.

The wavelength of ultraviolet light from UV emitting means 54 can be changed adequately by replacement of UV lamps or filters in the UV emitting means.

When the recording method of the present invention uses cationic polymeric inks, it is preferable to heat the ink on the base material during or after being exposed to UV light.

A preferable heating means should be a heating plate which guides the movement of a base material. In this case, the ink on the base material is treated by heat coming from the heating plate.

Further, the heating means can be a hot-air blowing means that blows hot air onto the ink on the base material.

The ink on the base material should preferably be treated at 30 to 60° C. If the temperature is lower than 30° C., the ink on the base material may remain wet and the image quality is poor. Contrarily, if the temperature is higher than 60° C., the film base material may be shrunk and wrinkled.

Embodiments

Although the present invention has been fully described in connection with the preferred embodiments thereof with reference to the accompanying drawings, it is to be understood that the invention is not intended to these specific embodiments.

[Preparation of Ink]

Inks of ingredients listed in Table 1 below were prepared in accordance with the law by dispersing pigment, dispersing agent and polymeric compound by a bead mill for 2 hours, adding photo-induced polymerization initiator, surface active agent, and amine compound thereto, mixing and filtering thereof. The resulting inks are all cationic and polymeric.

PY138: C.I. Pigment Yellow 138 whose surface is basic-treated.

PR19: C.I. Pigment red 19 whose surface is basic-treated.

PB15: 4: C.I. Pigment blue 15:3 whose surface is acidic-treated.

PBk7: C.I. Pigment black 7 whose surface is acidic-treated.

PB822: AjiSpur PB822 fabricated by Ajinomoto-Fine-Techno Co., Inc. (polymer dispersing agent, acid value of 18.5, and amine value of 15.9).

OXT221: Alon oxetane OXT221 fabricated by Toagosei Co., Ltd. (polymeric compound).

C2021P: Celoxide 2021P fabricated by Daicel Chemical Industries. Ltd. (polymeric compound).

SP152: Tri-arylsulfonium salt SP152 fabricated by Asahi Denka Kogyo K.K. (photo-induced polymerization initiator).

F1405: MEGAFACE F-1405 fabricated by Dainippon Ink And Chemicals, Inc. (surface active agent).

TIPA: Tri-iso-propanol amine (amine compound).

TABLE 1

| | Ink No. | | | | | | |
|---|---|---|---|---|---|---|---|
| | 1 | 2 | 3 | 4 | 5 | 6 | 7 |
| | Ink composition No. | | | | | | |
| | 1 | 2 | 3 | 4 | 5 | 2 | 7 |
| PY138 | 3 | — | — | — | 3 | — | — |
| PR19 | — | 2.5 | — | — | — | 2.5 | — |
| PB15:4 | — | — | 2.5 | — | — | — | — |
| PBk7 | — | — | — | 2.5 | — | — | 2.5 |
| PB822 | 1 | 1 | 1 | 1 | 1 | 1 | 2 |
| OXT221 | 61.68 | 62.18 | 62.18 | 62.18 | 79.68 | 62.18 | 61.18 |
| C2021P | 28 | 28 | 28 | 28 | 10 | 28 | 28 |
| SP152 | 5 | 5 | 5 | 5 | 5 | 5 | 5 |
| F1405 | 0.02 | 0.02 | 0.02 | 0.02 | 0.02 | 0.02 | 0.02 |
| TIPA | 0.1 | 0.1 | 0.1 | 0.1 | 0.1 | 0.1 | 0.1 |
| Water | 1.2 | 1.2 | 1.2 | 1.2 | 1.2 | 1.2 | 1.2 |

Each ingredient value is in % by mass.

Characteristics of the prepared inks were evaluated as described below.

Coarse particles: Spread each prepared ink 3 μm thick on a transparent PET film and counted coarse pigment particles of 1 μm or greater in the viewing field of 1 $mm^2$ under an optical microscope.

Ink viscosity 1: 25 °C., shear rate=$1000s^{-1}$

Ink viscosity 2: 55 °C., (Ejection control temperature), shear rate=$1000s^{-1}$ Free dispersing agent: Quantitatively determined by LC-MS.

The test results are listed in Table 2.

TABLE 2

| | Ink No. | | | | | | |
|---|---|---|---|---|---|---|---|
| | 1 | 2 | 3 | 4 | 5 | 6 | 7 |
| Coarse particles (particles/1000 $\mu m^2$) | 3 | >500 | <1 | <1 | 3 | 5 | <1 |
| Ink viscosity1 (mPa · s) | 42.5 | 34.8 | 30.1 | 32.0 | 33.0 | 34.5 | 30.9 |
| Ink viscosity2 (mPa · s) | 14.7 | 12.7 | 8.9 | 10.1 | 10.8 | 12.7 | 9.6 |
| Free dispersing agent (%) | <0.3 | <0.3 | <0.3 | <0.3 | <0.3 | <0.3 | 1.5 |

Image recording tests were made using the prepared inks under the conditions below.

An inkjet recording apparatus of FIG. 5 was used for the image recording tests.

The nozzle pitch of the recording head is 360 dpi (dots per inch). The recording head is a piezoelectric head capable of ejecting three 4-picoliter droplets per pixel.

The drive waveforms of FIGS. 4(A) and 4(B) were used. The inks were heated up to 55° C. The drive voltages were controlled depending upon ink viscosities. The velocity of the tenth main droplet (10th shot) and the number of satellites of the droplet were measured at a point at which the main droplet is 1 mm away from the nozzle by the stroboscopic photography. To check the continuous ejection ability, the recording apparatus was run continuously for one hour at full duty and then the printout was checked for ink-missing and fluctuation. The results of evaluation are represented by "A" representing "good", and "C" representing "unallowable".

Gray scales of 1 droplet per pixel and 3 droplets per pixel were used at a resolution of 720×720 dpi, using the above prepared inks.

A step chart of each color was created by the 3-time interleaving method (6 passes) for evaluation of image qualities.

FGS (fabricated by YUPO Corp.) was used as the base material. Ink droplets were jetted onto the base material which is heated to 40° C. and fixed by UV light. The UV light source was a low-pressure mercury lamp of a wavelength of 254 nm.

Table 3 lists speeds of the inkjet head and ink limitations (droplet ratio) per color (each head).

[Evaluation]

(Background Contamination by Ink Mists)

Background contamination (scumming) due to ink mists were checked for in the non-imaging area next to the solid print area. The results of evaluation are represented by three symbols "A", "B" and "C", where "A" represents "good", "B" represents "fair" and "C" represents "unallowable".

(Graininess)

The graininess in the areas from Highlight to Halftone was evaluated. The results of evaluation are represented by three symbols "A", "B" and "C", where "A" represents "good", "B" represents "fair" and "C" represents "unallowable".

(Character Quality)

The results of character quality evaluation are represented by three symbols "A", "B", and "C" as shown below.

A: 4-point characters read clearly.

B: 4-point alphanumeric characters read normally.

C: 4-point alphanumeric characters are blurred and hard to be recognized.

The results of character quality evaluation are listed in Table 3.

TABLE 3

| | Sample No. | | | | | | | | | |
|---|---|---|---|---|---|---|---|---|---|---|
| | 1 | 2 | 3 | 4 | 5 | 6 | 7 | 8 | 9 | 10 |
| | Ink No. | | | | | | | | | |
| | 1 | 2 | 3 | 4 | 5 | 6 | 7 | 2 | 4 | 4 |
| Drive voltage (V) | 21.5 | 20.2 | 17.5 | 17.5 | 18.3 | 20.2 | 19.2 | 20.2 | 17.5 | 17.5 |
| Driving waveform | B | B | B | B | B | B | B | A | B | B |
| Main droplet velocity (m/s) | 6.0 | 6.0 | 6.0 | 6.0 | 6.0 | 6.0 | 6.0 | 6.0 | 6.0 | 6.0 |
| Distance to satellite (μm) | 450 | 800 | 200 | 350 | 380 | 480 | 800 | 500 | 350 | 350 |
| Number of satellites (pcs) | 8 | 15 | 2 | 5 | 8 | 7 | 12 | 9 | 5 | 5 |
| Continuous ejection ability | A | A | A | A | A | A | C | A | A | A |
| Carriage velocity (mm/s) | 400 | 400 | 400 | 400 | 400 | 400 | 400 | 400 | 600 | 600 |
| Ink limitation: Droplet ratio (%) | 100 | 100 | 100 | 100 | 100 | 100 | 100 | 100 | 100 | 80 |
| Scumming due to ink mist | B | C | A | A | A | B | C | B | B | A |
| Graininess | A | C | A | A | A | A | C | A | B | A |
| Character quality | A | C | A | A | A | A | C | A | B | A |

It is apparent that the configuration of the present invention can provide excellent image qualities.

Similarly, the above image recording tests were made with raising the ink temperature to 60° C. at the time of ejection.

The results of evaluation are listed in Table 4.

TABLE 4

| | Sample No. | | | | |
|---|---|---|---|---|---|
| | 11 | 12 | 13 | 14 | 15 |
| | Ink No. | | | | |
| | 1 | 2 | 3 | 4 | 7 |
| Drive voltage (V) | 16.7 | 15.0 | 13.2 | 13.3 | 14.9 |
| Drive waveform | B | B | B | B | B |
| Main droplet velocity (m/s) | 6.0 | 6.0 | 6.0 | 6.0 | 6.0 |
| Distance to satellite (μm) | 330 | 500 | — | 210 | 450 |
| Number of satellites | 4 | 8 | 0 | 3 | 5 |
| Continuous ejection ability | A | A | A | A | A |
| Carriage velocity (mm/s) | 400 | 400 | 400 | 400 | 400 |
| Ink limitation: Droplet ratio (%) | 100 | 100 | 100 | 100 | 100 |
| Scumming due to ink mist | A | A | A | A | A |
| Graininess | A | B | A | A | A |
| Character quality | A | B | A | A | B |

Since the ink viscosity went down, the drive voltage to eject a main droplet velocity at 6 mm/s also went down. This improves the ink ejection ability.

In an inkjet recording method of jetting out droplets of ink of 5 to 20 mPa.s which is comparatively high viscous, high-definition images can be recorded stably for a long time with suppressed background contamination due to ink mists by making the velocity of the main droplet body faster than 5 mm/s at a point at which the droplet is 1 mm away from the nozzle surface and making the distance between the main droplet body and the satellite at the end shorter than 500 μm there.

While the preferred embodiments of the present invention have been described using specific terms, such description is for illustrative purposes only, and it is to be understood that changes and variations may be made without departing from the spirit or scope of the appended claims.

What is claimed is:

1. An inkjet recording method comprising:

ejecting an ink droplet having viscosity from 5 to 20 mPa·s from a nozzle of an inkjet head of an inkjet recording device toward a recording medium;

forming a main droplet and at least one satellite out of the ink droplet;

controlling a drive voltage of the inkjet head to make conditions that a velocity of the main droplet is at least 5 m/s at a point 1 mm away from a surface of the nozzle, and that a distance, in a perpendicular direction to a surface of the recording medium, between the main droplet, at the point 1 mm away from the nozzle surface, and a satellite formed last out of the ink droplet, is at most 500 μm; and recording an image of the ink on the recording medium.

2. The inkjet recording method of claim 1, wherein the at least one satellite is at most 10 satellites.

3. The inkjet recording method of claim 1, wherein the viscosity of the ink to be ejected is controlled to be between 5 to 12 mPa·s for recording.

4. The inkjet recording method of claim 1, wherein the ink is hardened by ultraviolet rays.

5. The inkjet recording method of claim 1, wherein ink limitation control is applied to limit a number of ink droplets to be ejected from inkjet nozzles.

6. The inkjet recording method of claim 1, wherein the ink is a high-viscosity ink whose viscosity is at least 10 mPa·s at 25°C., and the ink is heated to have viscosity within 5 to 20 mPa·s for recording.

7. The inkjet recording method of claim 6, wherein the viscosity of the ink to be ejected is controlled to be between 5 to 12 mPa·s for recording.

8. The inkjet recording method of claim 1, wherein the ink comprises a pigment as a color material, and the ink contains not more than five large pigment particles having diameters of at least 1 μm, per 1000 $\mu m^2$ of microscope field when a 3 μm thick layer of the ink is formed on a transparent base material.

9. The inkjet recording method of claim 8, wherein the ink comprises a polymer dispersant to disperse the pigment and a content of the polymer dispersant free from the pigment is 1% or less with respect to an amount of the polymer dispersant.

10. The ink-jet recording method of claim 1, wherein the inkjet recording device is a multi-drop driving type, which utilizes a plurality of main droplets ejected with a single series of drive waveform.

11. The ink-jet recording method of claim 1, wherein a drive waveform for a main droplet at the end, which is ejected last in a set of the plurality of main droplets, is different from drive waveforms for the plurality of main droplets excluding the main droplet at the end.

* * * * *